US009174335B1

(12) United States Patent
O'Dell

(10) Patent No.: US 9,174,335 B1
(45) Date of Patent: Nov. 3, 2015

(54) CONNECTION BETWEEN HANDLE AND END EFFECTOR OF TOOL

(71) Applicant: The O'Dell Corporation, Ware Shoals, SC (US)

(72) Inventor: William B. O'Dell, Greenwood, SC (US)

(73) Assignee: The O'Dell Corporation, Ware Shoals, SC (US)

( * ) Notice: Subject to any disclaimer, the term of this patent is extended or adjusted under 35 U.S.C. 154(b) by 0 days.

(21) Appl. No.: 14/522,765

(22) Filed: Oct. 24, 2014

Related U.S. Application Data

(60) Provisional application No. 61/899,487, filed on Nov. 4, 2013.

(51) Int. Cl.
*B25G 3/24* (2006.01)
*B25G 3/20* (2006.01)

(52) U.S. Cl.
CPC .. *B25G 3/24* (2013.01); *B25G 3/20* (2013.01); *Y10T 16/469* (2015.01)

(58) Field of Classification Search
CPC ..... Y10T 16/44; Y10T 16/469; Y10T 16/48; Y10T 16/4713; Y10T 29/49959; Y10S 16/24; B25G 3/00; B25G 3/12; B25G 3/24; B25G 3/20; B25G 1/06; B25G 1/04
USPC ..... 16/110.1, 422, 431, DIG. 24, 426; 15/143.1, 146, 147.1, 176.2, 176.5, 15/176.6, 229.2, 22.1, 145; 294/57, 58; 81/489; 29/525.08
See application file for complete search history.

(56) References Cited

U.S. PATENT DOCUMENTS

| | | | | | |
|---|---|---|---|---|---|
| 1,400,954 | A * | 12/1921 | Holloway et al. | ..... | 401/124 |
| 5,210,898 | A * | 5/1993 | Carey | ..... | 15/176.2 |
| 5,996,162 | A * | 12/1999 | Hsu | ..... | 15/144.1 |
| 6,154,913 | A * | 12/2000 | Burton | ..... | 15/160 |
| 6,609,847 | B1 * | 8/2003 | Wang | ..... | 401/137 |
| 6,634,822 | B1 * | 10/2003 | Wang | ..... | 401/137 |
| 6,830,271 | B2 * | 12/2004 | Piscopo et al. | ..... | 294/58 |
| 2003/0061676 | A1 * | 4/2003 | Warren | ..... | 15/176.2 |
| 2003/0180085 | A1 * | 9/2003 | Hughes | ..... | 401/289 |
| 2005/0273951 | A1 * | 12/2005 | Karl | ..... | 15/22.1 |

* cited by examiner

*Primary Examiner* — William Miller
(74) *Attorney, Agent, or Firm* — Michael A. Mann; Nexsen Pruet, LLC

(57) ABSTRACT

A device and method for making a tool for use in housekeeping or gardening is disclosed. The tool includes a handle and an end effector that are joined together using an end fitting attached to the end of the handle and a coupler attached to the end effector, such as a mop, brush, broom and the like. The end fitting and the coupler are fitted together and pinned using a clip to prevent rotation of one respect to the other. The end fitting and coupler may be fitted together with a threaded connection in addition to the clip and the end effector may be threaded and glued to the end effector. The end fitting may be received in the end fitting and secured with fasteners or be made integral to the end fitting.

19 Claims, 5 Drawing Sheets

CONNECTION BETWEEN HANDLE AND END EFFECTOR OF TOOL

PRIORITY CLAIM

Priority is claimed to U.S. provisional patent application Ser. No. 61/899,487, filed Nov. 4, 2013, which is incorporated in its entirety by reference.

BACKGROUND OF THE INVENTION

Many tools for housekeeping and gardening such as mops, brooms, brushes, rakes, hoes, and the like, have handles that are removable. For convenience, these various tools will simply be referred to as tools. These tools have end effectors, or more commonly "heads", attached to the ends of their handles and designed for mechanical purposes, such as sweeping, brushing, scraping, raking, cutting, mixing, and so forth. End effectors include mop heads, bristles, brushes, tines on rakes, the transverse blades on hoes, and so forth. The connection between the handles and end effectors is often a friction fitting, a threaded connection shown in FIG. 1, or mechanical fasteners such as pair of nails or screws.

SUMMARY OF THE INVENTION

The present invention is tool and method for making a tool for use in housekeeping or gardening including a handle and an end effector that are joined together using an end fitting attached to the end of the handle and a coupler attached to the end effector. End effectors include mops, brushes, brooms and the like. The end fitting and the coupler are fitted together and pinned using a clip to prevent rotation of one respect to the other. The end fitting and coupler may be fitted together with a threaded connection in addition to the clip and the end effector may be threaded and glued to the coupler. The end fitting may be received in the coupler and secured with fasteners or be made integral to the coupler.

DETAILED DESCRIPTION OF EMBODIMENTS

Figure 1:
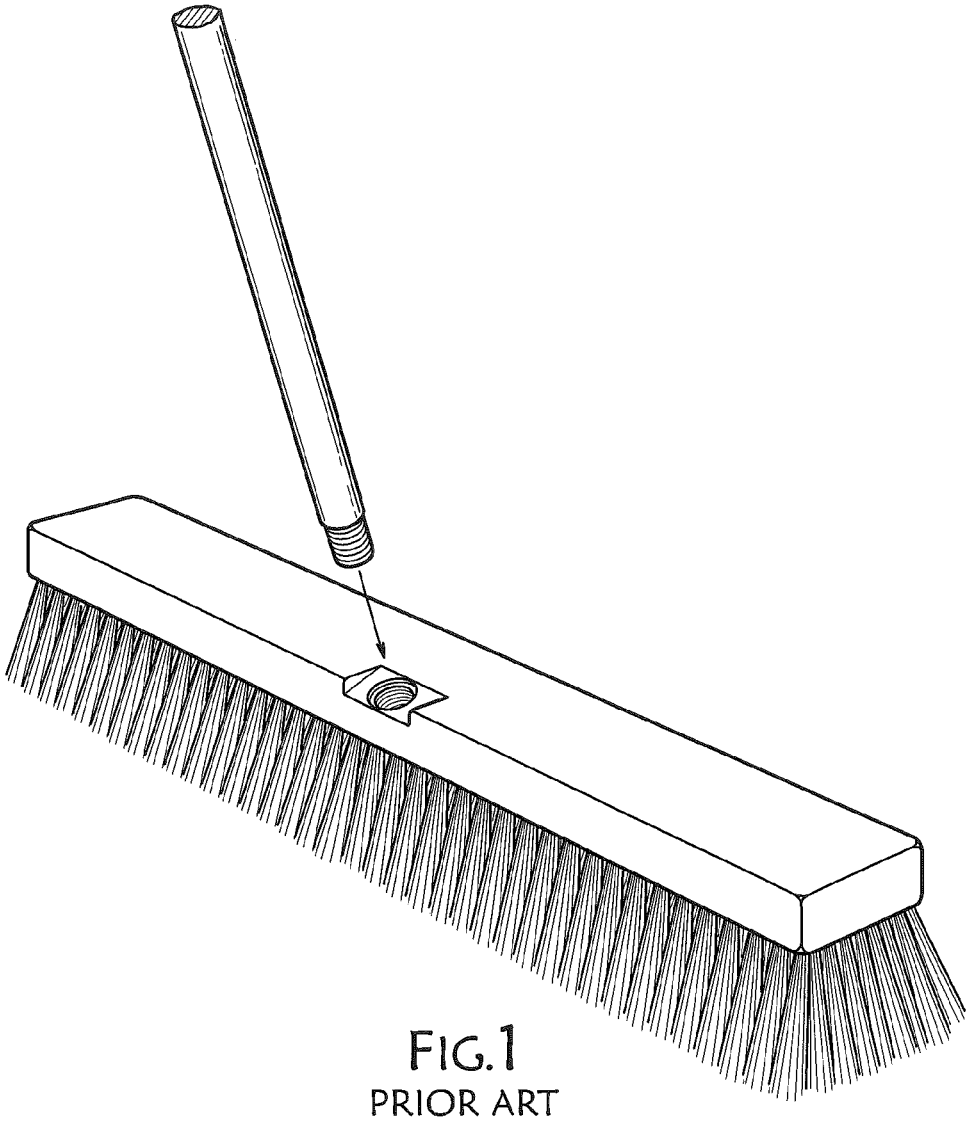
FIG. 1 PRIOR ART
FIG. 1 is a perspective, exploded view of a prior art floor broom with handle and brush block, as one type of end effector, and showing the threaded end of the handle and the threaded hole in the brush block.
Figure 2:
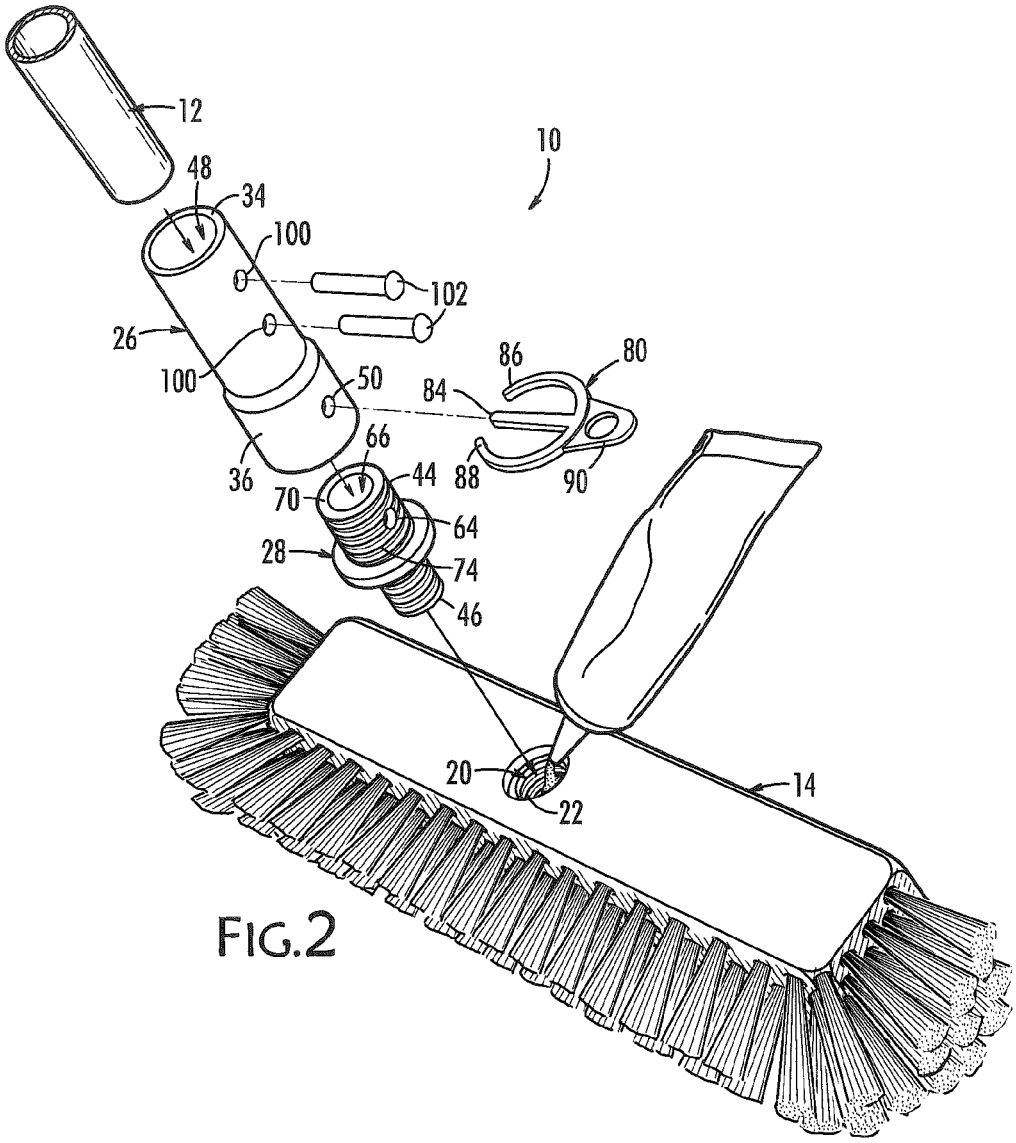
FIG. 2 is a perspective, exploded view of the present floor broom with handle and brush block type of end effector, and showing the end fitting, coupler, rivets and clip, as well as the application of an adhesive to secure the second end of the coupler to the brush block.
Figure 3:
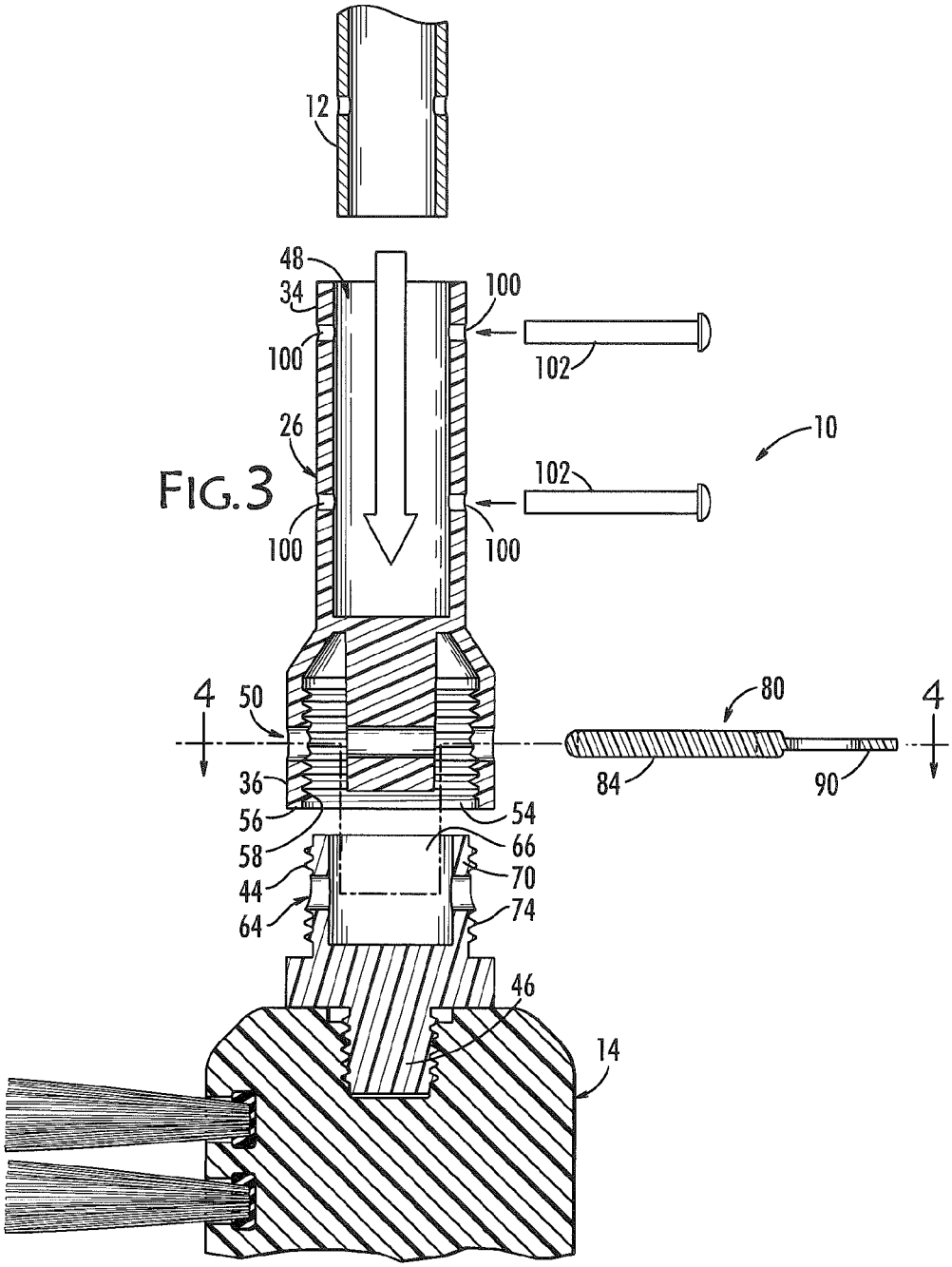
FIG. 3 is a side, exploded, cross-sectional view of the floor broom of FIG. 2 showing the recess in the first end of the end fitting for the handle, the interior threads and post with its groove in the second end of the adaptor, and the exterior threads of the first end of the coupler, as well as the diametrical passage through the second end of the end fitting and the first end of the coupler.

The present invention is a device for use with a tool having a handle attached to a removable end effector, and a tool with an improved connection between the handle and end effector, as well as a method for making the tool with an ends effector.

The present tool, generally indicated by reference number 10 in FIGS. 1-4, includes a handle 12 and an end effector 14 with a hole 20 formed in it. End effector 14 is a broom in FIGS. 1-4 but other end effectors may be substituted. For example, end effector 14 may be a mop, a sponge, a rake, a garden implement, or a brush. Handle 12 may be made of wood, plastic, metal, or composite material or combinations of these such as metal- or fiber-reinforced plastic. Handle 12 may be hollow or solid.

Hole 20 in the end effector 14 may have interior threads 22. An end fitting 26 and a coupler 28 are used to facilitate the connection between handle 12 and end effector 14. End fitting 26 has a first end 34 dimensioned to receive handle 12 and an opposing second end 36, dimensioned to receive coupler 28. Coupler 28 has a first end 44 fitted to second end 36 of end fitting 26 and an opposing second end 46 joined to end effector 14. Second end 46 of coupler 28 may carry exterior threads 48 to join it to end effector 14 by threading the two together, or second end 46 of coupler 28 may be glued using adhesive 50 for permanent attachment, or both.

First end 34 of end fitting 26 has a recess 48 to receive handle 12. Second end 36 of end fitting 26 has a diametrical passage 50 formed thereacross and may have a recess 54 formed therein to define a wall 56 with interior threads 58. The term diametrical passage means that there is an obstruction-free, passage across a diameter of a body, in this case in end fitting 26. Any intervening structures in second end 36 of end fitting 26 are formed to have a hole, groove or a slot to keep diametrical passage 50 unobstructed.

First end 44 of coupler 28 fits to second end 36 of end fitting 26 and it, too, has a diametrical passage 64 formed therein so that, when first end 44 of coupler 28 is fully fitted to the second end 36 of end fitting 26, diametrical passages 50, 64, of end fitting 26 and coupler 28, respectively, are coaxially aligned with each other to form one diametrical passage.

First end 44 of coupler 28 may have a recess 66 formed therein that defines a wall 70. Wall 70 of coupler 28 may have exterior threads 74 and be fitted together with interior threads 58 of wall 56 of second end 36 of end fitting 26, or, alternatively, the interior and exterior threads may be reversed, or, still in another alternate embodiment, both end fitting 26 and coupler 28 may be compression-fitted together. Using a threaded fitting provides a more secure fitting and, with sufficiently tight tolerances, helps to align diametrical passages 50, 64 of end fitting 26 and coupler 28.

Figure 4:
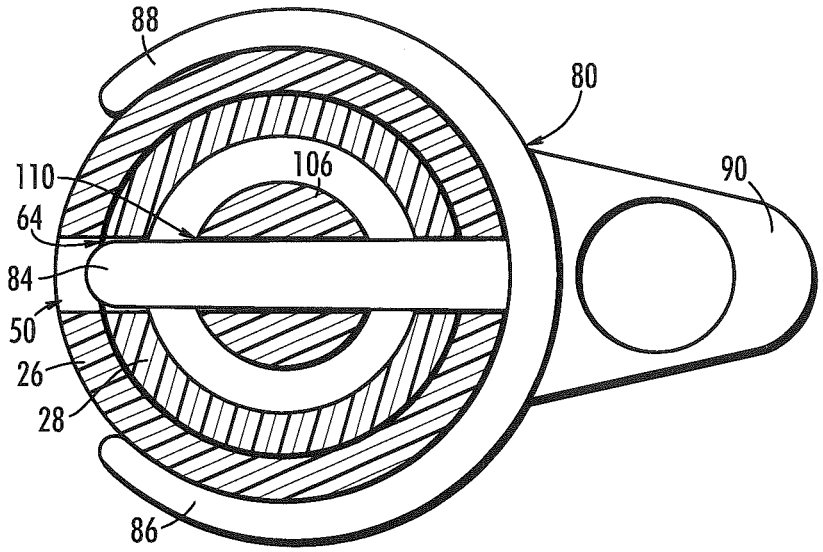
FIG. 4 is a cross-sectional view taken along lines 4-4 of FIG. 3, when the components of FIG. 3 are assembled, to show the relationship between the coupler and the end fitting as well as the positions of the pin and arms of the clip.

Finally, the present invention includes a clip 80 that has a pin 84 and two opposing arms 86, 88, as best seen in FIG. 4. Pin 84 is used to hold end fitting 26 and coupler 28 together and prevent their rotation with respect to each other. Pin 84 is dimensioned to pass through the aligned diametrical passages 50, 64 in end fitting 26 and coupler 28, respectively, when they are fully fitted together, and to have its opposing arms 86, 88, partially encircling end fitting 26. Opposing arms 86, 88, help to hold pin 84 in position. Clip 80 may also have a pull tab 90 to facilitate its removal from end fitting 26 when handle 12 and end fitting 26 are to be separated from coupler 28 and end effector 14.

First end 34 of the end fitting 26 may have one or more holes 100 formed in it to receive fasteners 102, such as screws, nails or rivets, one in each hole 100, that pass through hole 100 and into the material of handle 12 to secure first end 34 of end fitting 26 to handle 12.

Recess 54 in second end 36 of end fitting 26 may also have a post 106, oriented axially with respect to handle 12 and spaced apart from wall 56 defined by recess 54. Post 106 may have a groove 110, slot or hole formed therein, depending on its axial length, that is aligned with diametrical passage 50 of end fitting 26 and with diametrical passage 64 of coupler 28 to receive pin 84 of clip 80. Post 106 provides additional stability, strength and resists twisting of pin 84 of clip 80.

End fitting 26 may be made integral to handle 12 or may be a separate component.

Figure 5:
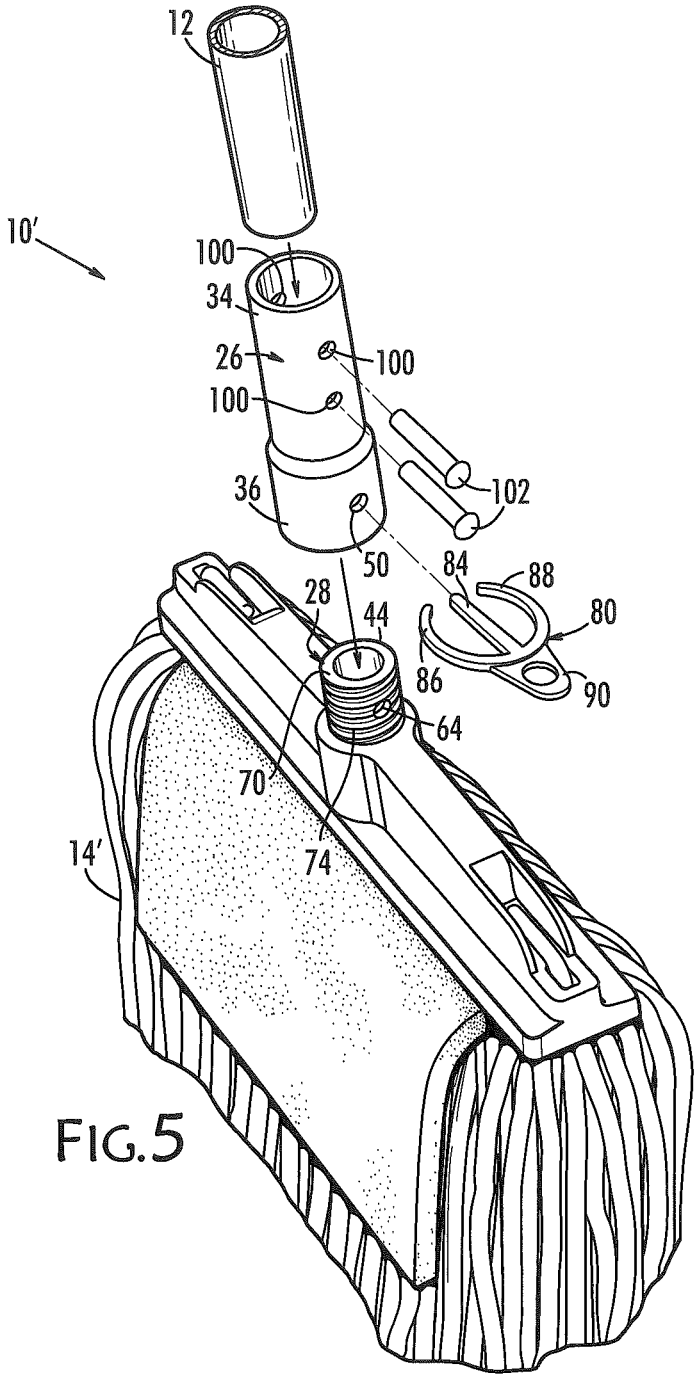
FIG. 5 is a perspective, exploded view of an alternative embodiment of the present invention with a mop head type of end effector, according to the present invention.

FIG. 5 shows an alternative end effector 14' for a tool 10', namely, a mop head but all of the components are otherwise essentially the same as for those shown in FIGS. 1-4. Other end effectors may also be used where a simple connection is needed that does not rotate but remains firm during use of the tool but is otherwise removable when convenient or when the end effector is worn and needs to be replaced or when a different end effector is needed.

The present invention is also a method for joining handle 12 to end effector 14. End effector 16 may be provided by molding it with an integral coupler 28, or, alternatively, providing end effector 16 with a hole 20 formed therein and then inserting second end 46 of coupler 28, held in place by friction fit or by adhesives. Alternatively, second end 46 of coupler 28 and hole 20 can both be threaded together.

Diametrical passage 64 is formed in first end 44 of coupler 28 and its exterior may be threaded. A recess 66 may also be formed in its first end 44.

End fitting 26 is provided with a second end 36 formed with threads complimentary to the threads formed on first end 44 of coupler 28. If those threads on first end 44 of coupler 28 are exterior threads, the threads on second end 36 of end fitting 26 are interior threads, for example. Furthermore, diametrical passage 50 is also formed in second end 36 of end fitting 26. When second end 36 of end fitting 26 is threaded or otherwise joined to first end 44 of coupler 28, diametrical passages 50, 64 must be coaxially aligned.

Handle 12 is provided to fit into recess 48 in first end 34 of end fitting 26. First end 34 of end fitting 26 may have plural holes 100 formed therein for receiving fasteners 102 that penetrate handle 12, such as nails, screws, or rivets. With handle 12 fully seated in recess 48 of first end 44 of end fitting 26, fasteners 102 are driven through holes 100 and into the material of handle 12. Pin 84 of clip 80 is inserted into the aligned diametrical passages 50, 64, of end fitting 26 and coupler 28 and its two opposing arms 86, 88, are wrapped around end fitting 26.

It will be clear to those skilled in the art of making housekeeping and gardening tools that many modifications and substitutions may be made to the preferred embodiments described herein without departing from the spirit and scope of the present invention which is defined by the appended claims.

What is claimed is:

1. A device for use with a tool having a handle and an end effector, said end effector having a hole formed therein, said device comprising:

(a) an end fitting having a first end with a recess dimensioned to receive said handle and an opposing second end having a recess defining a wall, said wall having interior threads, and said end fitting having a diametrical passage formed thereacross;

(b) a coupler having a first end and an opposing second end for engagement with the hole of the end effector, said first end of said coupler threadably fitting to said second end of said end fitting and having a diametrical passage formed thereacross so that, when said first end of said coupler is fully threadably fitted to said second end of end fitting, said diametrical passages of said coupler and said end fitting are coaxially aligned; and (c) a clip including a pin dimensioned to pass through said diametrical passages in said coupler and said end fitting when said coupler is joined to said end fitting, said clip having opposing arms partially encircling said end fitting.

2. The device as recited in claim 1, wherein said first end of said end fitting has a hole formed therein and wherein said device further comprises a fastener dimensioned to pass through said hole and into said handle to secure said end fitting to said handle.

3. The device as recited in claim 1, wherein said second end of said end fitting has a post axially oriented inside said recess of said second end, said post having a groove formed therein and aligned with said diametrical passage of said end fitting so as to form part of said diametrical passage.

4. The device as recited in claim 1, wherein said clip further comprises a pull tab.

5. A tool, comprising:

(a) an end effector with a hole formed therein;

(b) a coupler having a first end and an opposing second end, said first end having exterior threads and a diametrical passage thereacross and said second end dimensioned to fit into said hole in said end effector;

(c) a handle having a first end and an opposing second end, said second end carrying an end fitting having interior threads and having a diametrical passage formed thereacross so that, when said end fitting is threadably joined to said first end of said coupler, said diametrical passages of said end fitting and said coupler coaxially align; and (d) a clip with a pin, said clip fastening to said handle so that said pin extends through said diametrical passages of said coupler and said end fitting of said handle when said second end of said handle and said first end of said coupler are joined.

6. The tool of claim 5, wherein said clip has two opposing arms that extend around said end fitting to hold said pin in place in said diametrical passages of said coupler and said end fitting.

7. The tool of claim 5, wherein said end fitting has a recess with interior threads so that said handle can be threaded to said exterior threads of coupler.

8. The tool of claim 5, wherein said end fitting has a recess formed therein and a post axially oriented inside said recess, said post having a groove formed therein and aligned with said diametrical passage of said end fitting so as to form part of said diametrical passage for receiving said pin of said clip.

9. The tool as recited in claim 5, wherein said clip further comprises a pull tab.

10. The tool of claim 5 wherein said end fitting is integrally formed with said handle.

11. The tool of claim 10 wherein said end fitting has a first end with a recess dimensioned for receiving said handle.

12. The tool of claim 11, wherein said first end has plural holes formed therein and said tool further comprises plural fasteners, each fastener of said plural fasteners passing through one hole of said plural holes to secure said handle in said recess.

13. A method of making a tool, said method comprising the steps of:

(a) providing an end effector;

(b) forming a hole in said end effector;

(c) providing a coupler having a first end and a second end, said second end being dimensioned to be received in said hole in said end effector;

(d) forming a diametrical passage through said first end of said coupler;

(e) applying adhesive to said hole;

(f) inserting said second end of said coupler into said hole;
(g) providing an end fitting having a first end and an opposing second end;
(h) forming a diametrical passage through said second end of said end fitting, wherein said second end of said end fitting has a recess therein and with a post in said recess, said post having a diametrical groove formed therein, said groove being coaxially aligned with said diametrical passage in said second end of said end fitting;
(i) joining said second end of said end fitting to said first end of said coupler so that said diametrical passage of said end fitting and said diametrical passage of said coupler are coaxially aligned;
(j) providing a handle;
(k) joining said handle to said first end of said end fitting;
(l) and
(m) providing a clip having a pin; and
(n) placing said clip on said end fitting so that said pin passes through said diametrical passage of said end fitting and said coupler.

14. The method as recited in claim 13, wherein said hole forming step further comprises forming a threaded hole in said end effector, and further comprising the step of threading said second end of said coupler before inserting said second end of said coupler into said hole.

15. The method as recited in claim 13, wherein said clip has two opposing arms and wherein said method further comprises placing said two opposing arms around said end fitting.

16. The method as recited in claim 13, wherein said first end of said coupler is threaded and said second end of said end fitting is threaded and wherein said joining step further comprises threading said end fitting to said coupler.

17. A method of making a tool, said method comprising the steps of:
(a) providing an end effector;
(b) forming a hole in said end effector;
(c) providing a coupler having a first end and a second end, said second end being dimensioned to be received in said hole in said end effector;
(d) forming a diametrical passage through said first end of said coupler;
(e) applying adhesive to said hole;
(f) inserting said second end of said coupler into said hole;
(g) providing an end fitting having a first end and an opposing second end;
(h) forming a diametrical passage through said second end of said end fitting;
(i) joining said second end of said end fitting to said first end of said coupler so that said diametrical passage of said end fitting and said diametrical passage of said coupler are coaxially aligned;
(j) providing a handle;
(k) joining said handle to said first end of said end fitting;
(l) providing a clip having a pin and two opposing arms; and
(m) placing said clip on said end fitting so that said pin passes through said diametrical passage of said end fitting and said two opposing arms pass around said end fitting of said coupler.

18. The method as recited in claim 17, wherein said first end of said coupler is threaded and said second end of said end fitting is threaded and wherein said end fitting is threadably joined to said coupler.

19. A method of making a tool, said method comprising the steps of:
(a) providing an end effector;
(b) forming a hole in said end effector;
(c) providing a coupler having a first end and a second end, said second end being dimensioned to be received in said hole in said end effector;
(d) forming a diametrical passage through said first end of said coupler;
(e) applying adhesive to said hole;
(f) inserting said second end of said coupler into said hole
(g) providing an end fitting having a first end and an opposing second end, wherein said first end of said coupler is threaded and said second end of said end fitting is threaded;
(h) forming a diametrical passage through said second end of said end fitting;
(i) threadably joining said second end of said end fitting to said first end of said coupler so that said diametrical passage of said end fitting and said diametrical passage of said coupler are coaxially aligned;
(j) providing a handle;
(k) joining said handle to said first end of said end fitting;
(l) providing a clip having a pin; and
(m) placing said clip on said end fitting so that said pin passes through said diametrical passage of said end fitting and said coupler.

* * * * *